US008528179B2

(12) United States Patent
Kohler et al.

(10) Patent No.: US 8,528,179 B2
(45) Date of Patent: Sep. 10, 2013

(54) METHOD AND DEVICE FOR EXCHANGING ROLLER BATTERIES

(75) Inventors: Christian Kohler, Au (AT); Stefan Linder, Bregenz (AT); Josef Sutter, Bregenz (AT)

(73) Assignee: Innova Patent GmbH, Wolfurt (AT)

( * ) Notice: Subject to any disclaimer, the term of this patent is extended or adjusted under 35 U.S.C. 154(b) by 268 days.

(21) Appl. No.: 12/889,751

(22) Filed: Sep. 24, 2010

(65) Prior Publication Data

US 2011/0067218 A1 Mar. 24, 2011

(30) Foreign Application Priority Data

Sep. 24, 2009 (AT) ..... A 1503/2009

(51) Int. Cl.
*B61B 3/00* (2006.01)

(52) U.S. Cl.
USPC ..... 29/402.08; 104/112; 29/402.01; 29/402.03

(58) Field of Classification Search
USPC ..... 29/402.01, 402.03, 402.08; 104/173.1, 104/197, 198, 199, 112
See application file for complete search history.

(56) References Cited

U.S. PATENT DOCUMENTS

| | | | | |
|---|---|---|---|---|
| 1,690,929 | A * | 11/1928 | Fisher | 212/71 |
| 2,953,101 | A * | 9/1960 | Sommer | 104/173.1 |
| 3,710,726 | A * | 1/1973 | Buchholz et al. | 104/112 |
| 4,462,314 | A * | 7/1984 | Kunczynski | 104/115 |
| 5,081,932 | A * | 1/1992 | Hofmann | 104/112 |
| 5,570,638 | A * | 11/1996 | Egli et al. | 104/173.1 |
| 7,552,685 | B2 * | 6/2009 | Frangos et al. | 104/112 |
| 8,113,123 | B2 * | 2/2012 | Menser et al. | 104/127 |

* cited by examiner

*Primary Examiner* — Peter DungBa Vo
*Assistant Examiner* — Anthony Green
(74) *Attorney, Agent, or Firm* — Laurence A. Greenberg; Werner H. Stemer; Ralph E. Locher

(57) ABSTRACT

A method and a device for exchanging roller batteries on supports of cableway installations, include driving a service vehicle towards the support, lifting a cable which runs on the roller battery from the roller battery, then dismounting the roller battery and installing a new roller battery and finally relaying the cable on the roller battery.

29 Claims, 5 Drawing Sheets

METHOD AND DEVICE FOR EXCHANGING ROLLER BATTERIES

CROSS-REFERENCE TO RELATED APPLICATION

This application claims the priority, under 35 U.S.C. §119, of Austrian Patent Application A 1503/2009, filed Sep. 24, 2009; the prior application is herewith incorporated by reference in its entirety.

BACKGROUND OF THE INVENTION

Field of the Invention

The invention relates to a method for exchanging roller batteries on supports of cableway installations as well as a device for exchanging roller batteries on supports of cableways, with a service vehicle which can travel on a cable of the cableway.

Roller batteries on supports of cableway installations require regular servicing or maintenance. To date, that has been carried out directly on the support by service personnel. That, however, brings disadvantages along with it, since the working conditions on the support are not optimum.

SUMMARY OF THE INVENTION

It is accordingly an object of the invention to provide a method and a device for exchanging roller batteries, which overcome the hereinafore-mentioned disadvantages of the heretofore-known methods and devices of this general type and which simplify servicing and maintenance of roller batteries.

With the foregoing and other objects in view there is provided, in accordance with the invention, a method for exchanging roller batteries on supports of cableway installations. The method comprises driving a service vehicle towards a support, lifting a cable running on a roller battery from the roller battery, then dismounting the roller battery and installing a new roller battery and finally re-laying the cable on the roller battery.

With the objects of the invention in view, there is also provided a device for exchanging roller batteries on supports of cableways having a cable on which a service vehicle can travel. The device comprises a winch having at least one winch cable for lowering a roller battery to be exchanged to the ground after having been dismounted and for picking up a new roller battery from the ground, while the service vehicle is located in vicinity of a support.

Through the use of the invention, the roller battery is not serviced on the support, but rather the complete roller battery is replaced by a new or serviced roller battery. This is carried out by first making a new or serviced roller battery available on the ground beneath the support, then by lifting the cable from the existing roller battery, subsequently dismounting the roller battery and lowering it to the ground through the use of the winch, hoisting up and reinstalling the new or serviced roller battery, and finally re-laying the cable upon the roller battery. The old roller battery can be brought to a station or to another point of the cableway where it can be loaded onto a truck, preferably through the use of the service vehicle. The servicing can then be carried out in a factory building under ideal conditions.

Two embodiments are basically conceivable with the invention. In the case of a first embodiment, the service vehicle, during the exchanging of the roller battery, is located on the opposite side of the support and in a manner which is known per se is supported on the roller battery, or roller batteries, which is or are located there. The winch in this case is also located on the side opposite the roller battery which is to be exchanged.

In a second embodiment, the service vehicle is lifted from the cable and is fastened directly on the support before exchanging the roller battery. In the case of this embodiment, the service vehicle can also be located on the side of the support on which the roller battery that is to be exchanged is located since the service vehicle, if necessary with the cable on which the service vehicle is fastened, can be lifted from the roller battery, as a result of which the roller battery can be exchanged. Theoretically, the service vehicle could be lifted from the roller battery, or roller batteries, and fastened on the support in the case of the first embodiment as well.

The winch can be fastened on the service vehicle while the roller batteries are being installed and dismounted. A more stable and therefore more reliable embodiment of the invention, however, is distinguished by the roller batteries, through the use of a winch cable that is driven by a winch which is disposed on the support, being lowered to the ground and picked up therefrom. The advantage of the last-named embodiment is that the winch can be fastened more stably on the support than on the service vehicle. If, however, the service vehicle itself is fastened on the support, this disadvantage has little or no effect at all.

In the event that the winch is fastened on the support, this can be carried out in a simple manner by the winch being hoisted up on the support by the winch cable which is fastened on the support, especially on the yoke of the support, and being fastened on the support, especially on the yoke of the support, before installing or dismounting a roller battery.

In a preferred embodiment of the invention, the winch cable is deflected through at least one deflection roller which is disposed on the support, especially on the yoke of the support. This deflection roller is ideally disposed above the roller battery which is to be exchanged so that the roller battery can be installed and dismounted without disturbing lateral forces while it hangs on the winch cable.

The winch cable in the invention, however, can be used not only for hoisting up and lowering the roller batteries and for supporting the roller batteries when being installed and dismounted, but also for lifting the cable from the roller battery which is to be exchanged before it is exchanged and then re-laying it upon the new roller battery.

Furthermore, the winch can be used for bringing a new roller battery to a support on which a roller battery is to be exchanged and for transporting away the exchanged roller battery.

In the case in which the service vehicle is located on the opposite side of the support during exchange of the roller battery, this can be carried out so that a new roller battery can first of all be brought by the service vehicle beneath a roller battery which is to be exchanged and deposited on the ground, so that the service vehicle is then driven to the other side of the support and the roller battery then exchanged, and so that finally the service vehicle is driven back again to the side of the exchanged roller battery and the exchanged roller battery is picked up and transported away.

In order to achieve higher stability during the handling of the roller battery, it is preferred in the invention if two cable drums for winch cables are disposed on the winch and if the cable drums and the winch cables, as seen in the longitudinal direction of the cables, are disposed next to each and at a distance from each other.

Other features which are considered as characteristic for the invention are set forth in the appended claims.

Although the invention is illustrated and described herein as embodied in a method and a device for exchanging roller batteries, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 2:
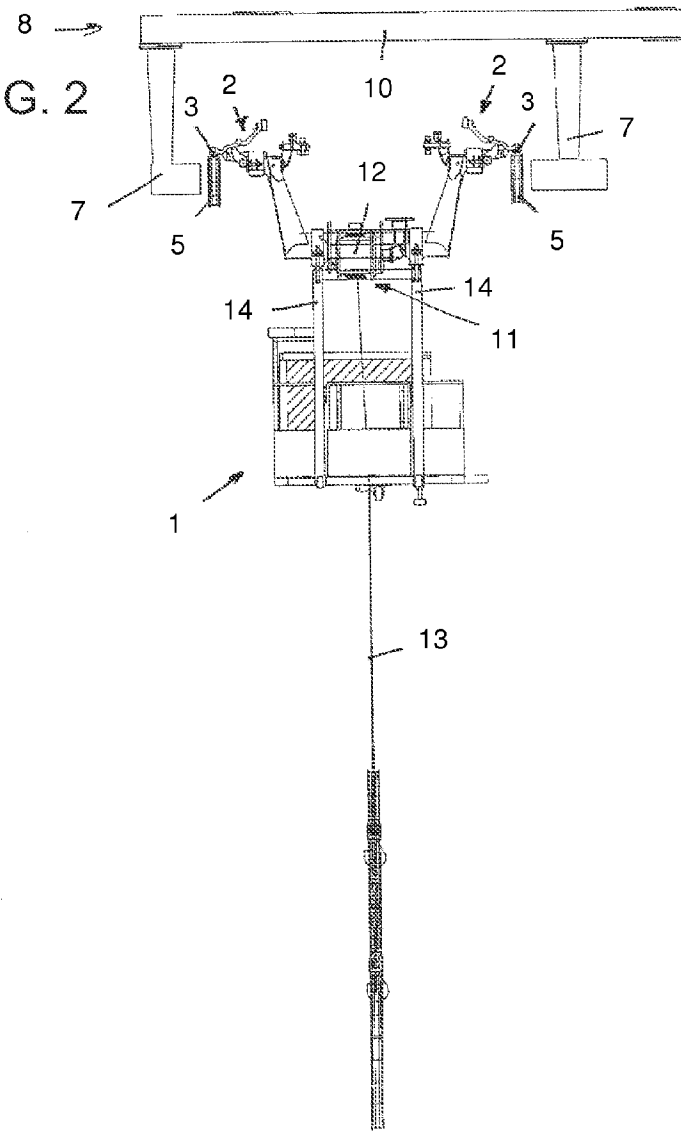
FIG. 2 is a front-elevational view of the configuration of FIG. 1, as seen from the left, with a part of a yoke of a support.

Referring now to the figures of the drawings in detail and first, particularly, to FIGS. 1 to 8 thereof, there is seen a first embodiment of the invention, in which a service vehicle 1 is connected through releasable clamps 2 to two synchronously running cables 3 and through the use of which the service vehicle can be conveyed, over supports 4, from one cableway station to another cableway station. The cables 3 run over roller batteries 5 on which a plurality of rollers 6 are rotatably mounted in a manner which is known per se. The roller batteries 5 are suspended by struts 7 from a yoke 8 of the supports 4. In the exemplary embodiment which is shown, the yoke 8 includes an upper boom 9 and a lower boom 10, with the struts being fastened on the lower boom 10.

The service vehicle 1 carries a winch 11 with two cable drums 12, on each of which a respective winch cable 13 can be wound on and wound off. The service vehicle 1 has a frame 14 on which the winch 11 is detachably fastened.

Figure 1:
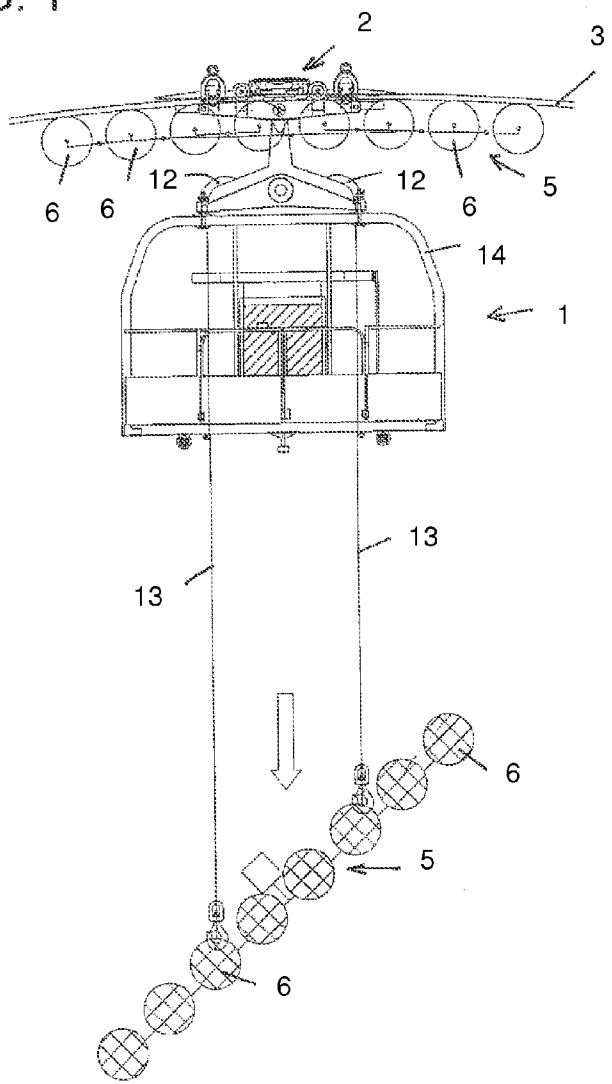
FIG. 1 is a diagrammatic, side-elevational view, without a support, of a first embodiment of the invention with two haulage and load carrying cables during transporting of a roller battery.
Figure 4:
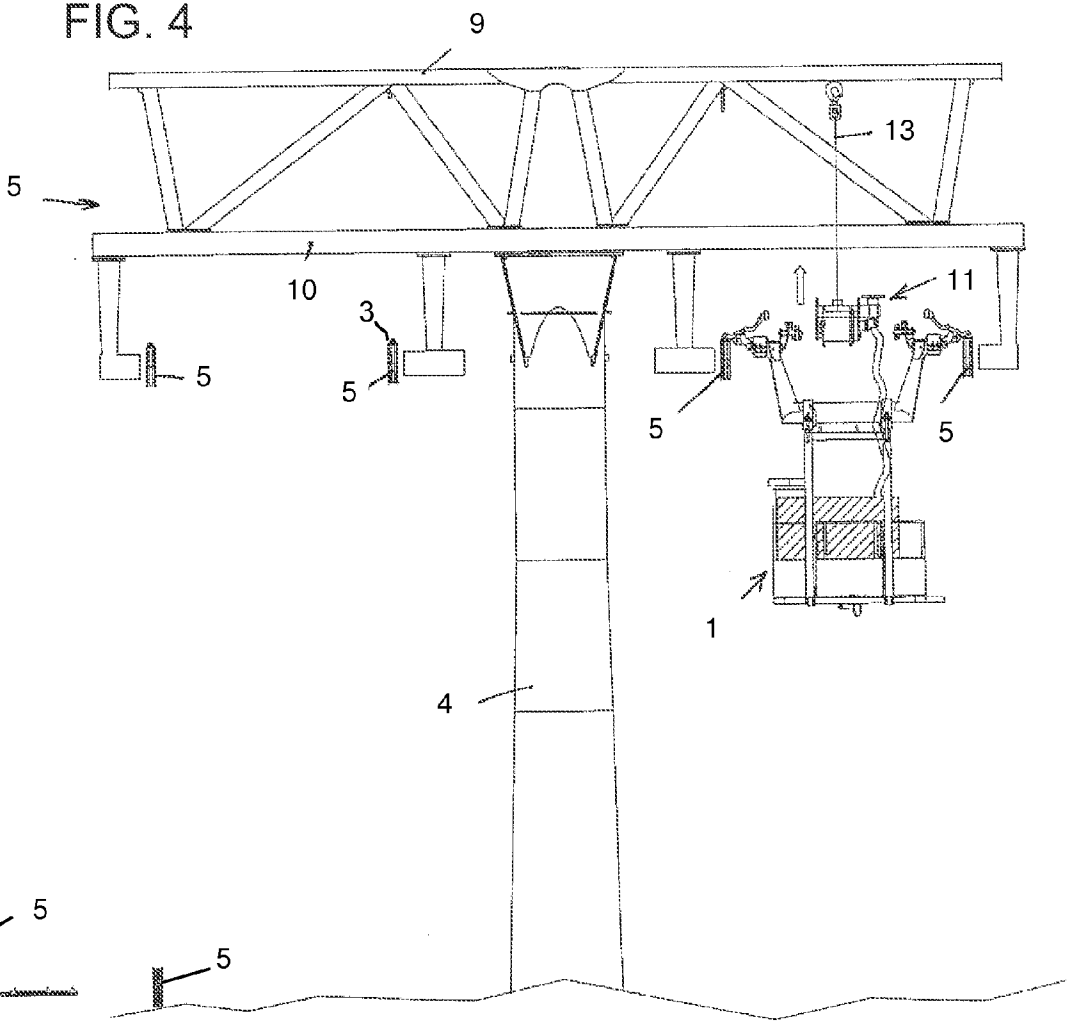
FIG. 4 is a front-elevational view of the configuration of FIG. 3, as seen from the left.
Figure 3:
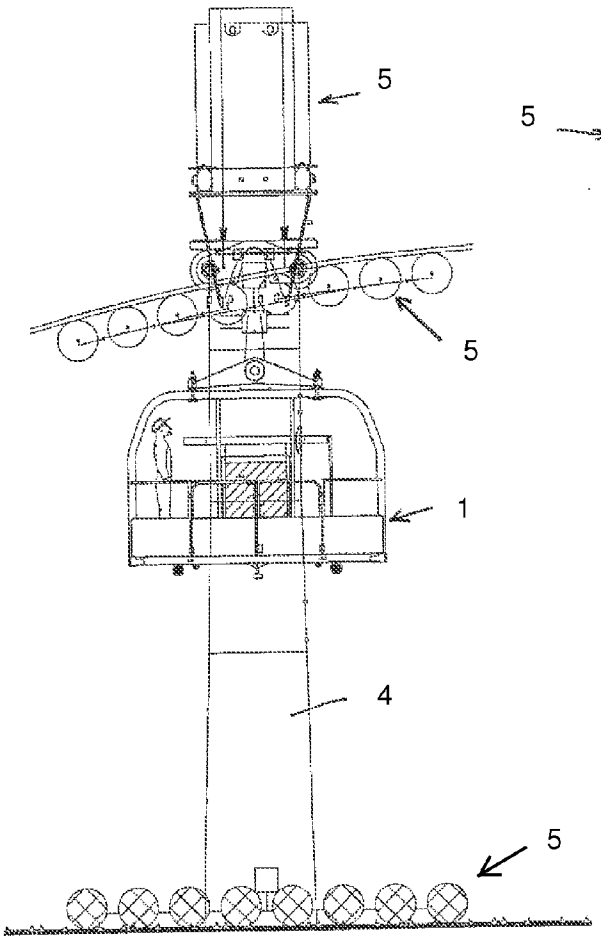
FIG. 3 is a side-elevational view of the configuration with a support while a winch is being hoisted up by a service vehicle.

FIGS. 1 and 2 show how the winch 11 with the winch cables 13 is used to transport a new or serviced roller battery 5 (represented by checkered rollers 6) beneath a roller battery 5 which is to be exchanged and is installed on a strut 7. If the service vehicle with the new roller battery 5 is located in the region beneath the yoke 8, the new roller battery 5 is deposited on the ground and the service vehicle 1 is driven in a known manner to the opposite side of the support 4. This situation is shown in FIGS. 3 and 4.

The two winch cables 13 are now attached to the upper boom 9 of the yoke 8 on suitable holders, for example iron rings 17 which are welded or screwed on the upper boom 9, after which the winch 11 can be released from the frame 14 and hoisted up to the lower boom 10. The winch 12 is then stably fastened on the lower boom 10.

Figure 6:
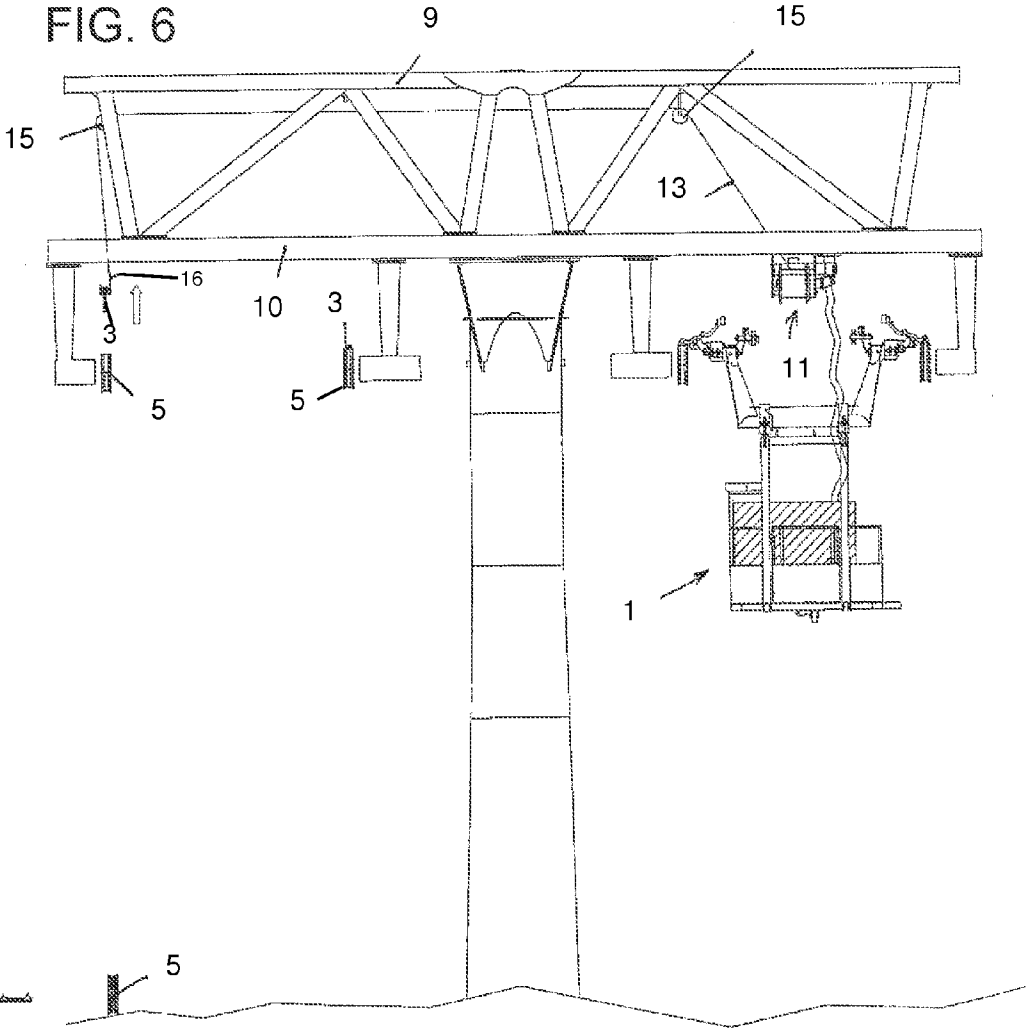
FIG. 6 is a front-elevational view of the configuration of FIG. 5, as seen from the left.
Figure 5:
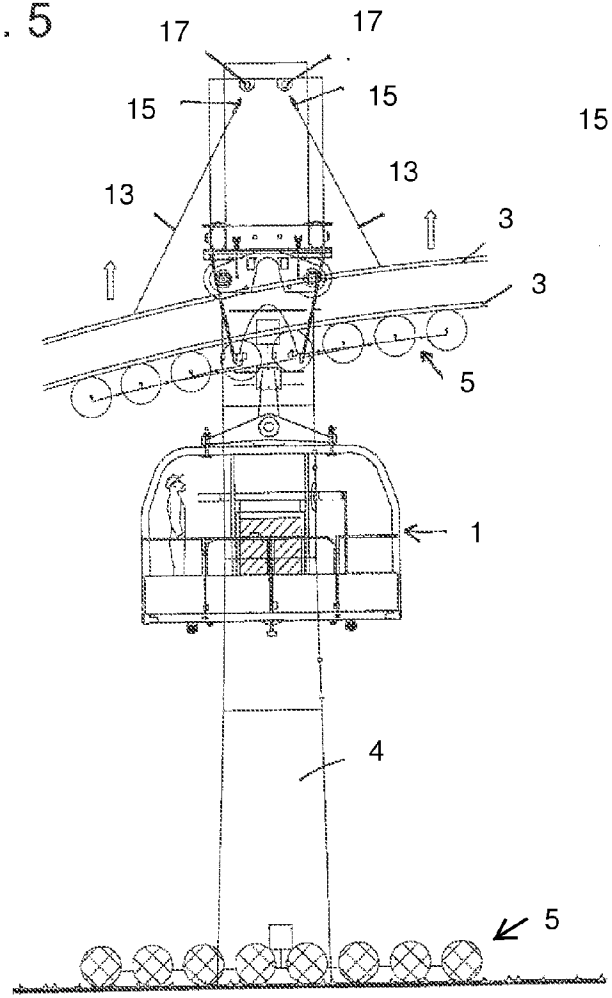
FIG. 5 is a side-elevational view of the configuration while a cable is being lifted from a roller battery.

The two winch cables 13 are subsequently laid over deflection rollers 15 which are mounted on the upper boom 9. Ideally, a deflection roller 15, or at least a mounting on which a deflection roller 15 can be fastened in a simple manner, is located over each roller battery 5 of a support. Through the use of the winch cables 13, the cable 3, which lies upon the roller battery 5 which is to be exchanged, can be lifted up and laid in a holder 16 in which it stays until the roller battery 5 has been exchanged. This situation is shown in FIGS. 5 and 6.

Figure 8:
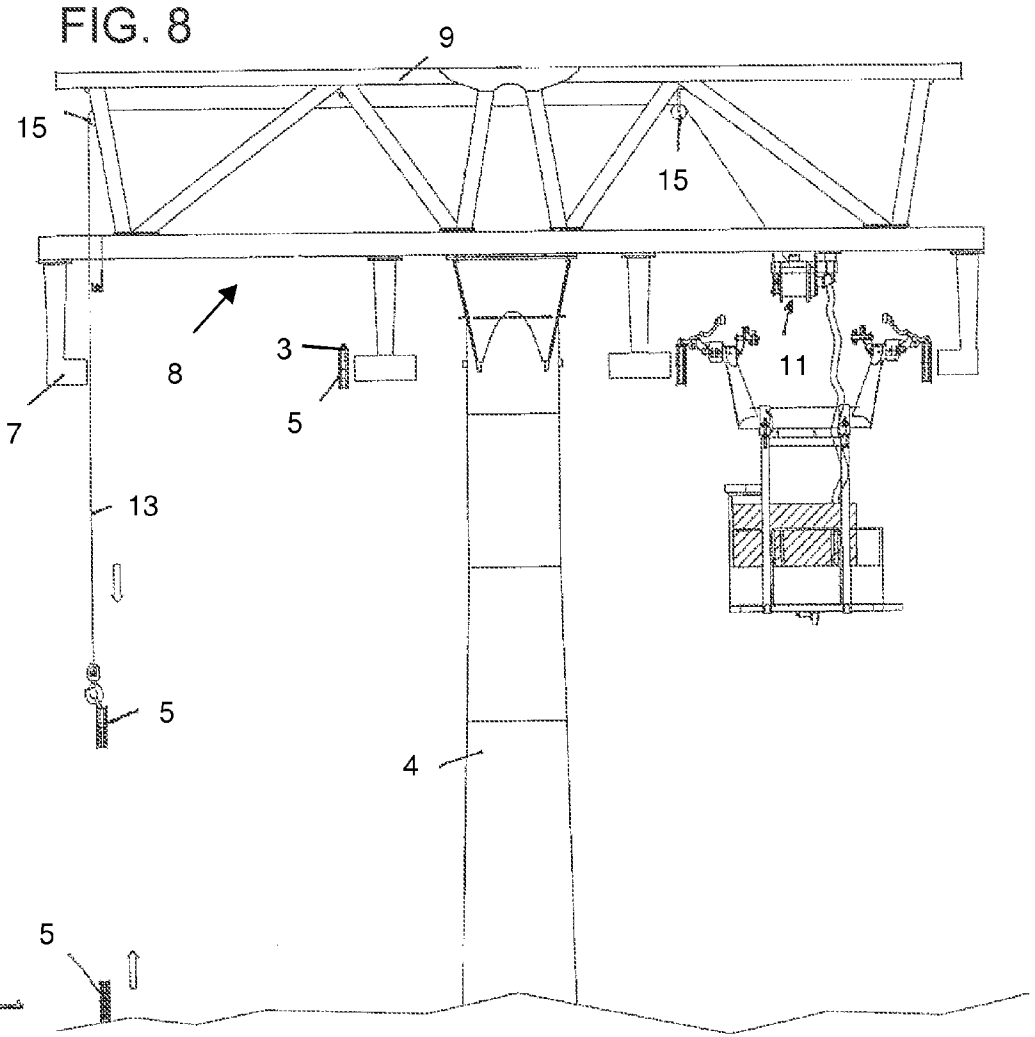
FIG. 8 is a front-elevational view of the configuration of FIG. 7, as seen from the left.
Figure 7:
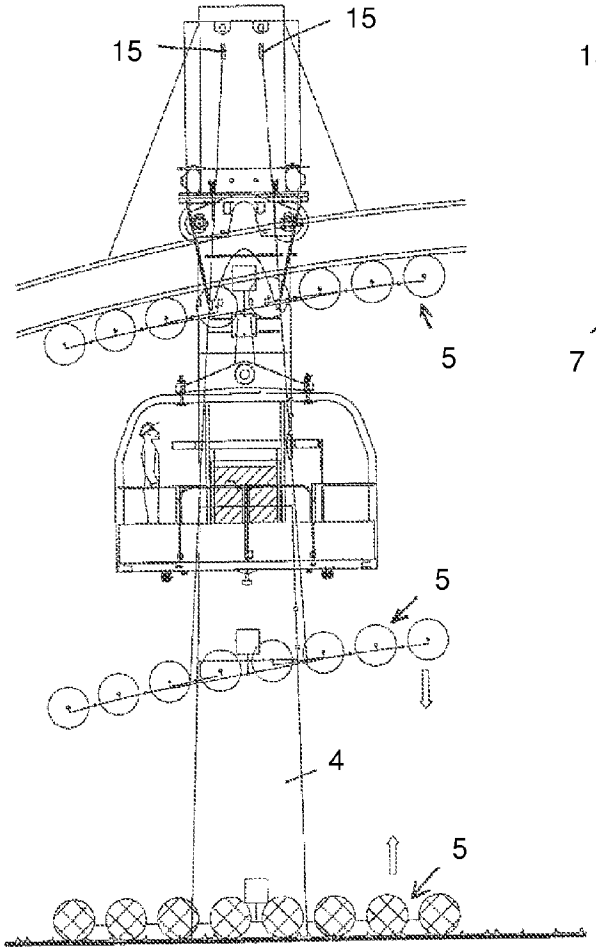
FIG. 7 is a side-elevational view of the configuration while a roller battery is being lowered from the support.

The two winch cables 13 are then fastened on the roller battery 5 which is to be exchanged, for example hooked on, and the winch cables 13 are tensioned to the extent that the roller battery 5 can be dismounted from the strut 7 and lowered to the ground, as is shown in FIGS. 7 and 8.

After the old roller battery 5 has been deposited on the ground and the new roller battery 5 hoisted up and installed on the strut 7, the cable 3 can be re-laid on the new roller battery 5 through the use of the winch cables 13.

After the winch cables 13 have been re-attached in the iron rings 17, the winch 11 can be lowered again to the service vehicle 1 and fastened thereon. The exchange of a roller battery 5 is now completely finished and the old roller battery 5 can be transported away by the service vehicle 1, in the same way as described in conjunction with FIGS. 1 and 2.

Figure 10:
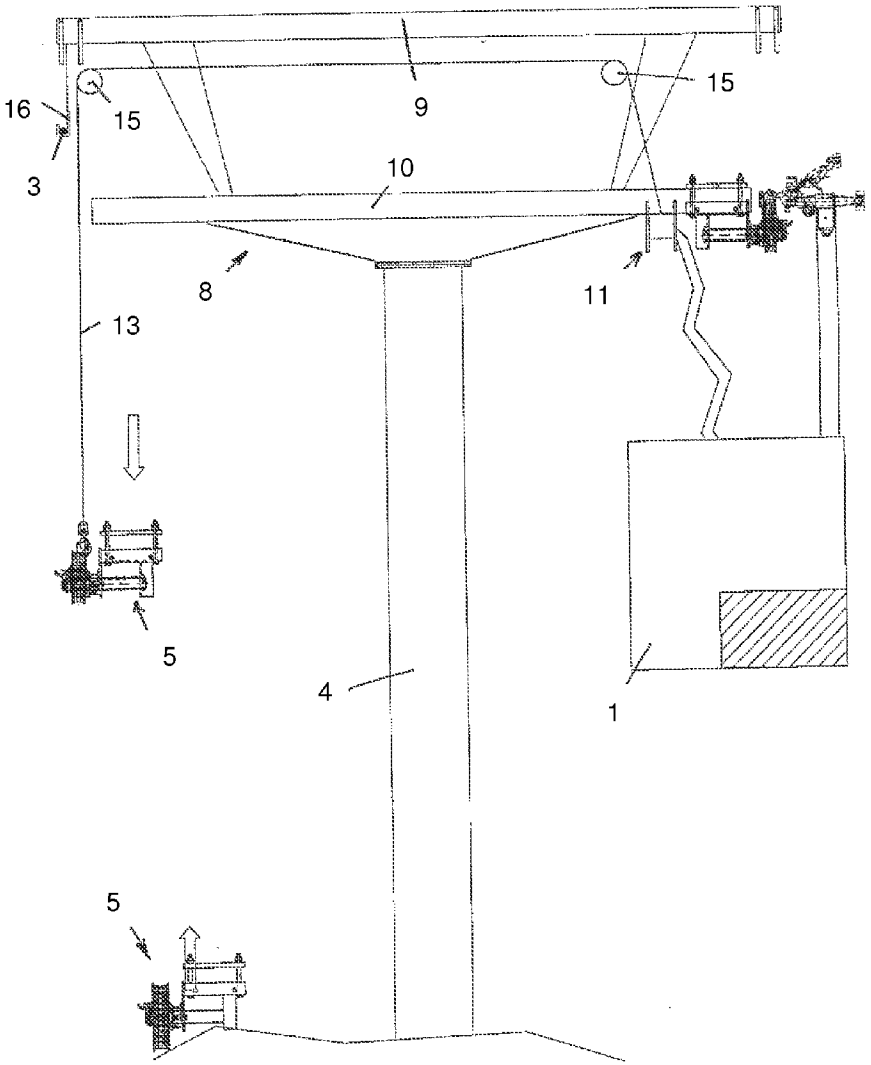
FIG. 10 is a front-elevational view of the configuration of FIG. 9, as seen from the left.
Figure 9:
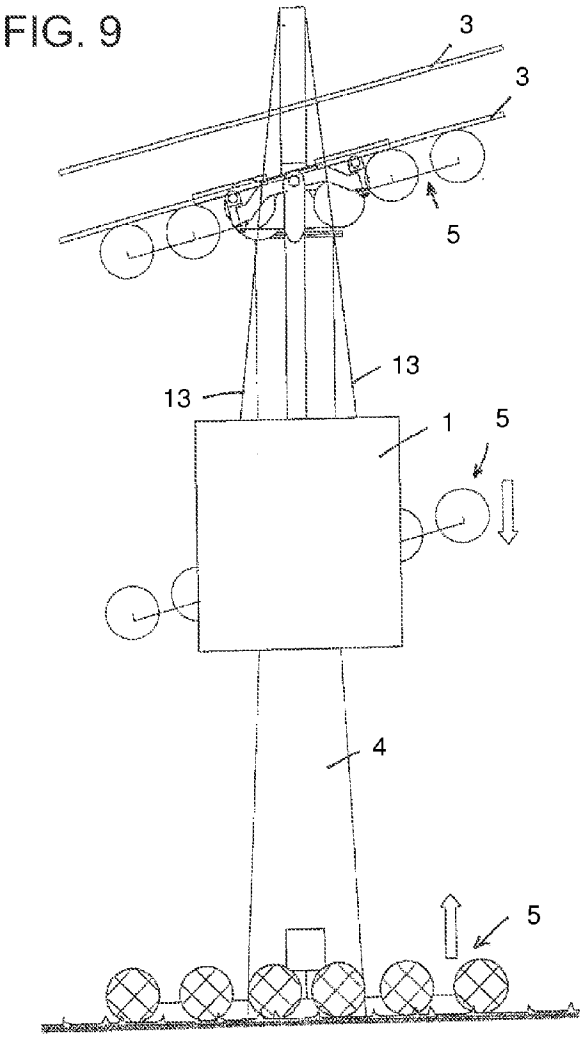
FIG. 9 is a side-elevational view of a second embodiment of the invention with a haulage and load carrying cable while a roller battery is being lowered from the support.

FIGS. 9 and 10 show an embodiment of the invention which is very similar to the embodiment according to FIGS. 1 to 8. The difference is simply that there is only a single encompassing cable 3 and not two parallel or synchronously encompassing cables 3 or cable loops and that the roller batteries 5 are not fastened on supports 7 but directly on the lower boom 10 of the support 4. The situation which is shown in FIGS. 9 and 10 substantially corresponds to the situation which is shown in FIGS. 7 and 8, wherein the procedure when exchanging the roller battery and the remaining structural details are kept largely the same.

The procedure as well as the construction of the device according to the invention, which are represented in conjunction with FIGS. 1 to 10, are distinguished by the service vehicle 1 and the winch 11 being disposed on the side of the support 4 which lies opposite the roller battery 5 that is to be exchanged. Also conceivable is an embodiment which is not shown in the drawings, in which the service vehicle 1 and the winch 11 are located on the same side of the support as the roller battery 5 that is to be exchanged, and therefore in the immediate vicinity of the roller battery 5 which is to be exchanged. The advantage of this embodiment is that the installing and dismounting of the roller battery 5 can be carried out from the service vehicle 1.

Since the cable 3 has to be lifted from the roller battery 5 which is to be exchanged, this embodiment provides for the service vehicle 1, if necessary with the cable 3 which is fastened thereupon through the coupling 2 (with both cables 3 in the case of two synchronously running cables 3), to be lifted from the roller battery 5, or from the two roller batteries. This can be carried out, for example, again through the use of the winch 11 with which in this case not only the winch 11 is hoisted up to the yoke 8 or lower boom 10 but also the service vehicle 1 which is connected to it and then fastened on the yoke 8 or on the lower boom 10. The rest of the procedure for installing and dismounting the roller battery 5 can take place as described earlier in conjunction with FIGS. 1 to 8.

The invention claimed is:

1. A method for exchanging a roller battery on a support of a cableway installation, the method comprising the following steps:

driving a service vehicle on cables of a cableway installation to a vicinity of a support;

lifting a cable running on a roller battery from the roller battery;

then dismounting the roller battery to be exchanged;

providing a winch with at least one winch cable guided over a deflection roller disposed on the support;

using the at least one winch cable for lowering the roller battery to the ground and picking up a new roller battery from the ground and installing the new roller battery; and finally re-laying the cable on the roller battery.

2. The method according to claim 1, which further comprises lifting the service vehicle from the cable and fastening the service vehicle directly on the support before exchanging the roller battery.

3. The method according to claim 1, which further comprises, during the exchanging of the roller battery, locating the service vehicle on an opposite side of the support and supporting the service vehicle on the roller battery located there.

4. The method according to claim 1, which further comprises providing the winch disposed on the service vehicle.

5. The method according to claim 1, which further comprises providing the winch disposed on the support.

6. The method according to claim 1, wherein the at least one deflection roller is disposed on a yoke of the support.

7. The method according to claim 4, which further comprises supporting the roller battery with the winch cable while being dismounted.

8. The method according to claim 5, which further comprises supporting the roller battery with the winch cable while being dismounted.

9. The method according to claim 4, which further comprises initially lifting the cable from the roller battery and laying the cable in a holder with the winch cable, and then supporting the roller battery while being dismounted.

10. The method according to claim 5, which further comprises initially lifting the cable from the roller battery and laying the cable in a holder with the winch cable, and then supporting the roller battery while being dismounted.

11. The method according to claim 5, which further comprises attaching the winch on the support before being used for lifting off and laying down the cable and/or for lowering and hoisting up the roller battery.

12. The method according to claim 1, which further comprises:

initially bringing a new roller battery beneath a roller battery to be exchanged and depositing the new roller battery on the ground, with the service vehicle;

then driving the service vehicle to the other side of the support and then exchanging the roller battery; and finally driving the service vehicle back again to the side of the exchanged roller battery and picking up and transporting away the exchanged roller battery.

13. The method according to claim 1, which further comprises hoisting the winch on the support with the winch cable fastened on the support and fastening the winch on the support, before installing and dismounting a roller battery.

14. The method according to claim 13, wherein the winch cable is fastened on a yoke of the support and the winch is fastened on the yoke of the support.

15. A device for exchanging a roller battery on a support of a cableway having a cable on which a service vehicle can travel, the device comprising:

a winch having at least one winch cable for lowering a roller battery to be exchanged to the ground after having been dismounted and for picking up a new roller battery from the ground, with the service vehicle being located in vicinity of a support; and at least one deflection roller disposed on the support, said at least one winch cable being guided said over at least one deflection roller.

16. The device according to claim 15, wherein said winch, in an operating state, is fastened on the service vehicle.

17. The device according to claim 15, wherein said winch, in an operating state, is fastened on the support.

18. The device according to claim 17, wherein said winch, in the operating state, is fastened on a yoke of the support.

19. The device according to claim 15, wherein said winch is configured to be fastened on the support in a region above the roller battery to be exchanged.

20. The device according to claim 19, wherein said winch is configured to be fastened on a yoke of the support.

21. The device according to claim 15, wherein said winch is configured to be fastened on the support at a side of the support opposite the roller battery to be exchanged.

22. The device according to claim 21, wherein said winch is configured to be fastened on a yoke of the support.

23. The device according to claim 15, wherein said at least one deflection roller is disposed on a yoke of the support.

24. A device for exchanging a roller battery on a support of a cableway having a cable on which a service vehicle can travel, the device comprising:

a winch having at least one winch cable for lowering a roller battery to be exchanged to the ground after having been dismounted and for picking up a new roller battery from the ground, with the service vehicle being located in vicinity of a support; and a holder disposed on the support, said at least one winch cable configured to be fastened on said holder for hoisting said winch on the support.

25. The device according to claim 24, wherein said holder is disposed on a yoke of the support.

26. The device according to claim 15, wherein said at least one winch cable includes two winch cables, and two cable drums for said winch cables are disposed on said winch.

27. The device according to claim 26, wherein said cable drums and said winch cables are disposed next to each other and at a distance from each other, in longitudinal direction of the cable.

28. The device according to claim 15, which further comprises a holder disposed on the support, above the roller battery, for receiving the cable.

29. The device according to claim 28, wherein said holder is disposed on a yoke of the support.

* * * * *